US009310733B2

(12) United States Patent
Yoshinaga et al.

(10) Patent No.: US 9,310,733 B2
(45) Date of Patent: Apr. 12, 2016

(54) FIXING DEVICE AND IMAGE FORMING APPARATUS INCLUDING SAME

(75) Inventors: Hiroshi Yoshinaga, Ichikawa (JP); Masaaki Yoshikawa, Tokyo (JP); Kenichi Hasegawa, Kanagawa (JP); Kenji Ishii, Kawasaki (JP); Akira Shinshi, Machida (JP); Naoki Iwaya, Chofu (JP); Yutaka Ikebuchi, Chigasaki (JP); Ippei Fujimoto, Ebina (JP); Yoshiki Yamaguchi, Sagamihara (JP); Shuntaroh Tamaki, Kawasaki (JP); Tetsuo Tokuda, Tokyo (JP); Takamasa Hase, Kawasaki (JP); Takahiro Imada, Yokohama (JP); Toshihiko Shimokawa, Zama (JP)

(73) Assignee: Ricoh Company, LTD., Tokyo (JP)

( * ) Notice: Subject to any disclaimer, the term of this patent is extended or adjusted under 35 U.S.C. 154(b) by 1032 days.

(21) Appl. No.: 12/929,626

(22) Filed: Feb. 4, 2011

(65) Prior Publication Data

US 2011/0194869 A1 Aug. 11, 2011

(30) Foreign Application Priority Data

Feb. 7, 2010 (JP) ..... 2010-024918

(51) Int. Cl.
*G03G 15/20* (2006.01)

(52) U.S. Cl.
CPC .... *G03G 15/2064* (2013.01); *G03G 2215/2035* (2013.01)

(58) Field of Classification Search
CPC ..... G03G 2215/2022; G03G 2215/2025; G03G 2215/2035; G03G 15/2085; G03G 15/2064
USPC ..... 399/69, 122, 328, 329
See application file for complete search history.

(56) References Cited

U.S. PATENT DOCUMENTS 6,131,009 A 10/2000 Hasegawa
6,496,666 B2 12/2002 Hayashi et al.

(Continued)

FOREIGN PATENT DOCUMENTS

CN 101183235 5/2008
CN 101609293 12/2009

(Continued)

OTHER PUBLICATIONS

JP-08262903-A is the corresponding abstract for JP-3298354-B2.

(Continued)

*Primary Examiner* — David Gray
*Assistant Examiner* — Andrew V Do
(74) *Attorney, Agent, or Firm* — Harness, Dickey & Pierce, P.L.C.

(57) ABSTRACT

A fixing device includes a substantially cylindrical metal member, a heater, an endless, flexible fixing member, a rotary pressing member, and a stationary member. The heater heats the metal member. The fixing member is disposed rotatable around the metal member. An inner circumferential surface of the fixing member is heated by the metal member to heat and fix a toner image. The rotary pressing member is disposed opposite the metal member and pressed against an outer circumferential surface of the fixing member to form a nip between the rotary pressing member and the fixing member through which a recording medium bearing the toner image passes. The stationary member is disposed in pressure contact with the inner circumferential surface of the fixing member, and has an opposing face opposing the rotary pressing member and having a curvature smaller than a curvature of the rotary pressing member.

16 Claims, 6 Drawing Sheets

(56) References Cited

U.S. PATENT DOCUMENTS

| | | | | |
|---|---|---|---|---|
| 6,591,081 | B2 | 7/2003 | Hasegawa | |
| 6,628,916 | B2 | 9/2003 | Yasui et al. | |
| 6,636,709 | B2 | 10/2003 | Furukawa et al. | |
| 6,778,804 | B2 | 8/2004 | Yoshinaga et al. | |
| 6,785,505 | B2 | 8/2004 | Yasui et al. | |
| 6,813,464 | B2 | 11/2004 | Amita et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 7,022,944 | B2 | 4/2006 | Yoshinaga et al. | |
| 7,070,182 | B2 | 7/2006 | Hasegawa | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,515,850 | B2 | 4/2009 | Hasegawa | |
| 7,546,049 | B2 | 6/2009 | Ehara et al. | |
| 7,570,910 | B2 | 8/2009 | Ishii | |
| 7,593,680 | B2 | 9/2009 | Shinshi | |
| 7,630,652 | B2 | 12/2009 | Hasegawa | |
| 7,702,271 | B2 | 4/2010 | Yamada et al. | |
| 7,742,714 | B2 | 6/2010 | Shinshi et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,840,151 | B2 | 11/2010 | Fujimoto | |
| 7,869,753 | B2 | 1/2011 | Shinshi | |
| 2002/0009306 | A1 | 1/2002 | Hayashi et al. | |
| 2002/0018663 | A1 | 2/2002 | Furukawa et al. | |
| 2002/0044805 | A1 | 4/2002 | Hasegawa | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0165348 | A1 | 9/2003 | Amita et al. | |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2004/0178573 | A1 | 9/2004 | Hasegawa | |
| 2004/0184851 | A1* | 9/2004 | Otsuka et al. | 399/329 |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0163543 | A1 | 7/2005 | Satoh et al. | |
| 2005/0180786 | A1 | 8/2005 | Yamada et al. | |
| 2005/0220507 | A1* | 10/2005 | Uehara et al. | 399/329 |
| 2006/0002737 | A1 | 1/2006 | Shinshi | |
| 2006/0029411 | A1 | 2/2006 | Ishii et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2006/0285893 | A1 | 12/2006 | Ishii | |
| 2007/0003334 | A1 | 1/2007 | Shinshi et al. | |
| 2007/0014600 | A1 | 1/2007 | Ishii et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0077104 | A1 | 4/2007 | Hasegawa | |
| 2007/0166085 | A1 | 7/2007 | Shinshi | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219721 | A1 | 9/2008 | Ito et al. | |
| 2008/0219730 | A1 | 9/2008 | Shinshi | |
| 2008/0226326 | A1 | 9/2008 | Seo et al. | |
| 2008/0232873 | A1 | 9/2008 | Ueno et al. | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0310862 | A1 | 12/2008 | Hasegawa | |
| 2008/0317532 | A1 | 12/2008 | Ehara et al. | |
| 2009/0003867 | A1 | 1/2009 | Fujimoto | |
| 2009/0010687 | A1 | 1/2009 | Yamada et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2009/0311016 | A1 | 12/2009 | Shinshi | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0329716 | A1* | 12/2010 | Condello et al. | 399/67 |

FOREIGN PATENT DOCUMENTS

| | | | |
|---|---|---|---|
| JP | 2884714 | B2 | 2/1992 |
| JP | 07-311505 | A | 11/1995 |
| JP | 3298364 | B2 | 10/1996 |
| JP | 09-244441 | A | 9/1997 |
| JP | 10213984 | A | 8/1998 |
| JP | 2003-131517 | A | 5/2003 |
| JP | 2004-020696 | A | 1/2004 |
| JP | 2004-029394 | | 1/2004 |
| JP | 2004-139039 | A | 5/2004 |
| JP | 2004258484 | A | 9/2004 |
| JP | 2005-331637 | A | 12/2005 |
| JP | 2005-345671 | | 12/2005 |
| JP | 2006-251068 | A | 9/2006 |
| JP | 2006-251069 | A | 9/2006 |
| JP | 2007-256693 | | 10/2007 |
| JP | 2007334205 | A | 12/2007 |
| JP | 2008-015419 | A | 1/2008 |
| JP | 2008-065264 | A | 3/2008 |
| JP | 2008146010 | A | 6/2008 |
| JP | 2008158482 | A | 7/2008 |
| JP | 2008-216928 | A | 9/2008 |
| JP | 2010-026415 | | 2/2010 |
| JP | 2010-026489 | | 2/2010 |

OTHER PUBLICATIONS

JP-04044075-A is the corresponding abstract for JP-2884714-B2.

* cited by examiner

FIXING DEVICE AND IMAGE FORMING APPARATUS INCLUDING SAME

CROSS-REFERENCE TO RELATED APPLICATIONS

The present patent application claims priority pursuant to 35 U.S.C. §119 from Japanese Patent Application No. 2010-024918, filed on Feb. 7, 2010 in the Japan Patent Office, which is incorporated herein by reference in its entirety.

BACKGROUND

1. Field

Exemplary embodiments of the present disclosure relate to a fixing device and an image forming apparatus including the fixing device, and more specifically, to a fixing device that applies heat and pressure to a recording medium at a nip formed between a fixing member and a pressing member to fix an image on the recording medium, and an image forming apparatus including the fixing device.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such a fixing device may include a cylindrical metal member to heat the fixing device effectively to shorten a warm-up time or a time to first print (hereinafter also "first print time"). Specifically, the metal member is provided inside a loop into which an endless fixing belt is formed, facing a portion or the entire of the inner circumferential surface of the fixing belt. The metal member is heated by a built-in or external heater so as to heat the fixing belt. A pressing roller presses against the outer circumferential surface of the fixing belt at a position corresponding to the location of the metal member inside the loop formed by the fixing belt to form a nip between the fixing belt and the pressing roller through which the recording medium bearing the toner image passes. As the recording medium bearing the toner image passes through the nip, the fixing belt and the pressing roller apply heat and pressure to the recording medium to fix the toner image on the recording medium.

Such a fixing device is described, for example, in JP-2008-158482-A. The fixing device disclosed therein has the advantage of preventing faulty fixing even when the warm-up time and/or first print time are shortened to speed up the fixing process. Although generally successful for its intended purpose, however, better fixing performance of fixing images are needed to meet users' demand for higher image quality. To cope with such challenges, for example, it is conceivable to increase the width and/or surface pressure of the nip. For such a configuration, however, although the fixing performance of a fixing image is enhanced, cockling might occur in a recording medium discharged from the nip. Alternatively, friction resistance at the nip might be increased, resulting in increased driving torque.

SUMMARY

In an aspect of this disclosure, there is provided an improved fixing device including a substantially cylindrical metal member, a heater, an endless, flexible fixing member, a rotary pressing member, and a stationary member. The heater heats the metal member. The fixing member is disposed rotatable around the metal member. An inner circumferential surface of the fixing member is heated by the metal member to heat and fix a toner image. The rotary pressing member is disposed opposite the metal member and pressed against an outer circumferential surface of the fixing member to form a nip between the rotary pressing member and the fixing member through which a recording medium bearing the toner image passes. The stationary member is disposed in pressure contact with the inner circumferential surface of the fixing member, and has an opposing face opposing the rotary pressing member and having a curvature smaller than a curvature of the rotary pressing member.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
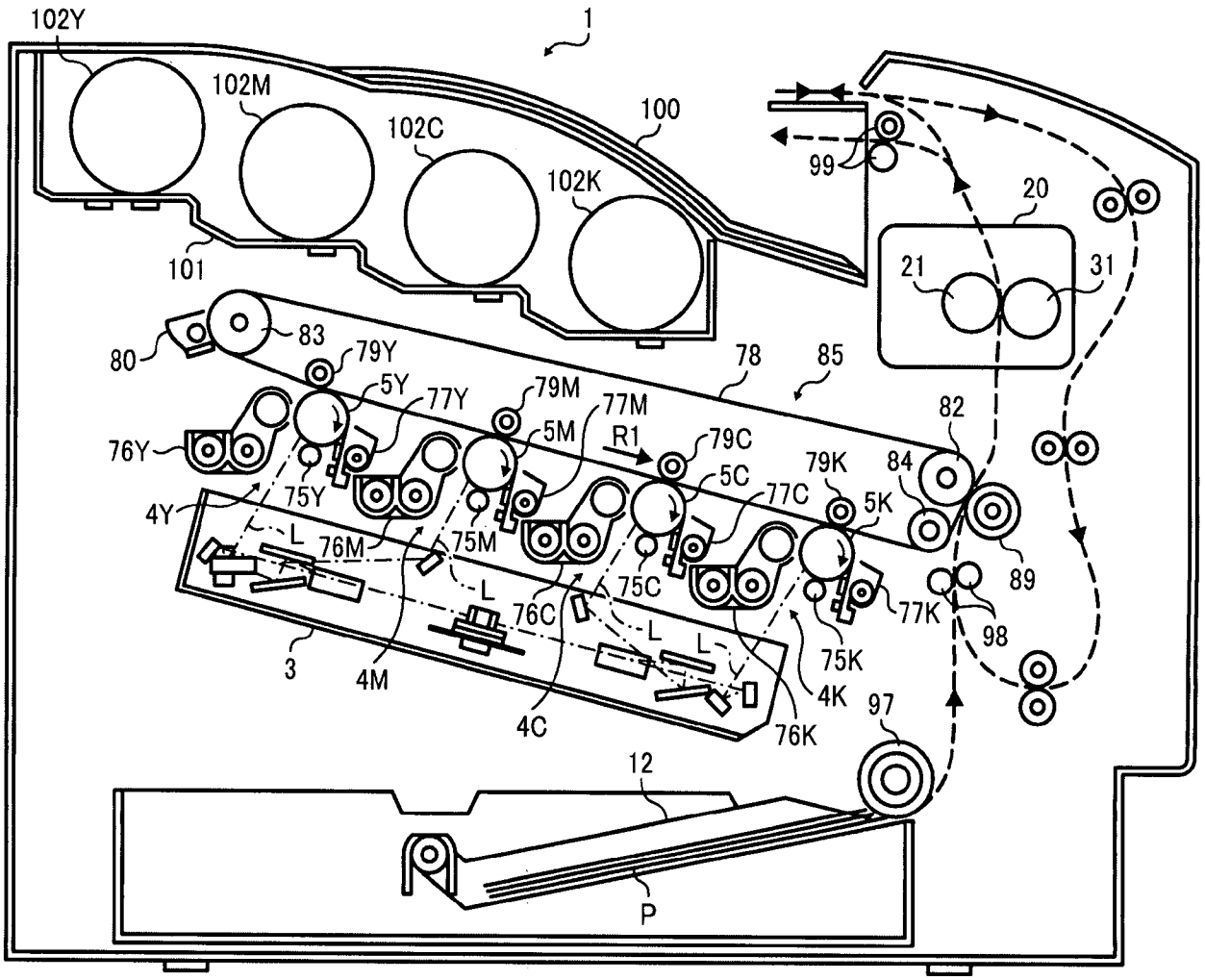
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, in particular to FIG. 1, an image forming apparatus 1 according to an exemplary embodiment of the present disclosure is described.

First, configuration and operation of the image forming apparatus 1 are described with reference to FIG. 1.

In FIG. 1, the image forming apparatus 1 is a tandem color printer for forming a color image on a recording medium. However, it is to be noted that the image forming apparatus may be any other suitable type of image forming apparatus, such as a copier, a facsimile machine, a printer, or a multifunction printer having at least one of copying, printing, scanning, plotter, and facsimile functions.

A toner bottle holder 1 is provided in an upper portion of the image forming apparatus 1. Four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

An intermediate transfer unit 85 is provided below the toner bottle holder 101. Image forming devices 4Y, 4M, 4C, and 4K are arranged opposite an intermediate transfer belt 78 of the intermediate transfer unit 85, and form yellow, magenta, cyan, and black toner images, respectively.

The image forming devices 4Y, 4M, 4C, and 4K include photoconductive drums 5Y, 5M, 5C, and 5K, respectively. Further, chargers 75Y, 75M, 75C, and 75K, development devices 76Y, 76M, 76C, and 76K, cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

Accordingly, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The intermediate transfer unit 85 includes the intermediate transfer belt 78, the first transfer bias rollers 79Y, 79M, 79C, and 79K, an intermediate transfer cleaner 80, a second transfer backup roller 82, a cleaning backup roller 83, and a tension roller 84. The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The color toner image formed on the intermediate transfer belt 78 reaches the second transfer nip. At the second transfer nip, a second transfer roller 89 and the second transfer backup roller 82 sandwich the intermediate transfer belt 78. The second transfer roller 89 transfers the color toner image formed on the intermediate transfer belt 78 onto the recording medium P fed by a registration roller pair 98 at the second transfer nip formed between the second transfer roller 89 and the intermediate transfer belt 78. After the transfer of the color toner image, residual toner, which has not been transferred onto the recording medium P, remains on the intermediate transfer belt 78.

Then, the intermediate transfer belt 78 reaches the position of the intermediate transfer cleaner 80. The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

A paper tray 12 is provided in a lower portion of the image forming apparatus 1, and loads a plurality of recording media P (e.g., transfer sheets). A feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip. Thus, a color toner image is formed on the recording medium P.

The recording medium P bearing the color toner image is sent to a fixing device 20. In the fixing device 20, a fixing belt 21 and a pressing roller 31 apply heat and pressure to the recording medium P to fix the color toner image on the recording medium P. An output roller pair 99 discharges the recording medium P to an outside of the image forming apparatus 1, that is, a stack portion 100. Thus, the recording media P discharged by the output roller pair 99 are stacked on the stack portion 100 successively to complete a single sequence of image forming processes performed by the image forming apparatus 1.

Figure 2:
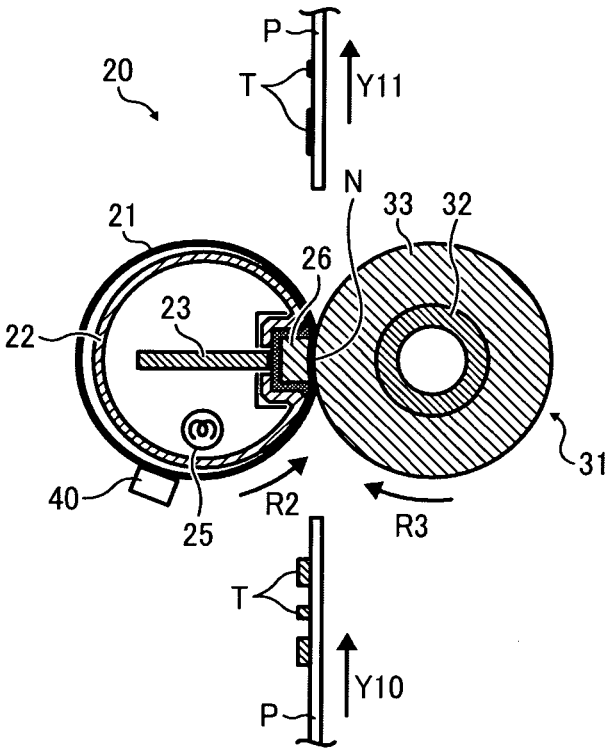
FIG. 2 is a vertical sectional view of a fixing device of the image forming apparatus shown in FIG. 1.
Figure 3:
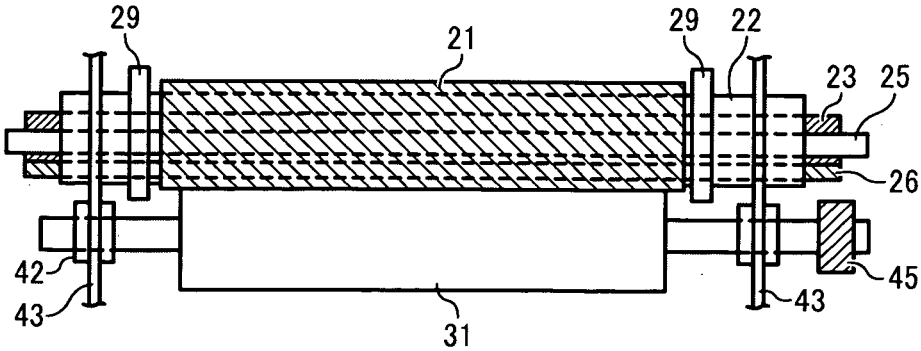
FIG. 3 is a plan view of the fixing device shown in FIG. 2.
Figure 4:
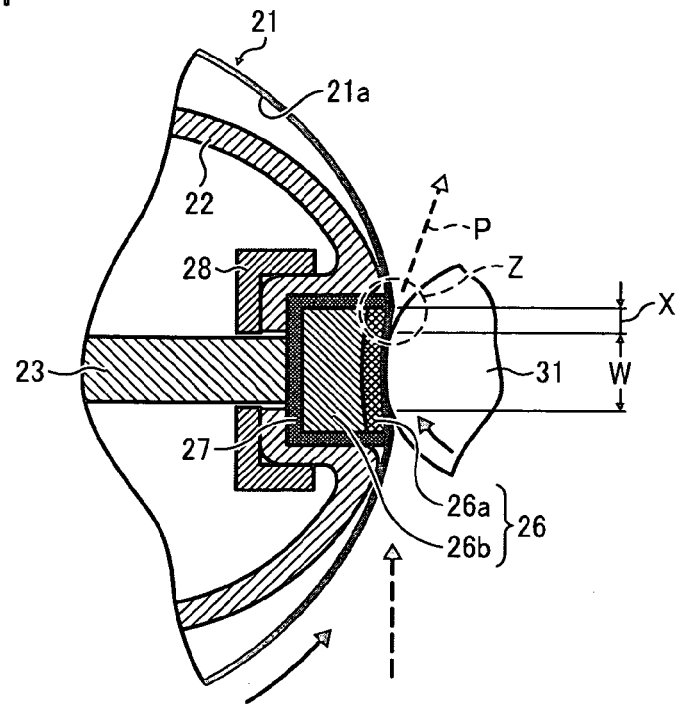
FIG. 4 is an enlarged view of a nip and its neighboring area of the fixing device shown in FIG. 2.

Referring to FIGS. 2 to 4, the following describes the structure and operation of the fixing device 20.

As illustrated in FIGS. 2 to 4, the fixing device 20 includes the fixing belt 21 serving as a fixing member or a belt member, a stationary member 26, a metal member 22 serving as a heating member, a reinforcement member 23, a heater 25 serving as a heat source, the pressing roller 31 serving as a rotary pressing member, a temperature sensor 40, a heat insulator 27, and a stay 28.

The fixing belt 21 may be a thin, flexible endless belt that rotates or moves counterclockwise in FIG. 2, i.e., in a rotation direction R2 indicated by an arrow in FIG. 2. The fixing belt 21 is constructed of a base layer, an intermediate elastic layer, and a surface release layer, and has a total thickness not greater than approximately 1 mm. The base layer includes an inner circumferential surface 21*a* serving as a sliding surface which slides over the stationary member 26. The elastic layer is provided on the base layer. The release layer is provided on the elastic layer.

The base layer of the fixing belt 21 has a thickness in a range of from approximately 30 μm to approximately 50 μm, and includes a metal material such as nickel and/or stainless steel, and/or a resin material such as polyimide.

The elastic layer of the fixing belt 21 has a thickness in a range of from approximately 100 μm to approximately 300 μm, and includes a rubber material such as silicon rubber, silicon rubber foam, and/or fluorocarbon rubber. The elastic layer eliminates or reduces slight surface asperities of the fixing belt 21 at a nip N formed between the fixing belt 21 and the pressing roller 31. Accordingly, heat is uniformly transmitted from the fixing belt 21 to a toner image T on a recording medium P, suppressing formation of a rough image such as an orange peel image.

The release layer of the fixing belt 21 has a thickness in a range of from approximately 10 μm to approximately 50 μm, and includes tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The diameter of the fixing belt 21 is set to approximately 15 mm to approximately 120 mm. In this exemplary embodiment, the fixing belt 21 has an inner diameter of, for example, approximately 60 mm. As illustrated in FIGS. 2 to 5, the stationary member 26, the heater 25, the metal member 22, the reinforcement member 23, the heat insulator 27, and the stay 28 are fixedly provided inside a loop formed by the fixing belt 21. In other words, the stationary member 26, the heater 25, the metal member 22, the reinforcement member 23, the heat insulator 27, and the stay 28 do not face an outer circumferential surface of the fixing belt 21, but face the inner circumferential surface 21*a* of the fixing belt 21. A lubricant intervenes between the fixing belt 21 and the metal member 22.

The stationary member 26 is fixed inside the fixing belt 21 in such a manner that the inner circumferential surface 21*a* of the fixing belt 21 slides over the stationary member 26. The stationary member 26 is pressed by the pressing roller 31 with the fixing belt 21 sandwiched between the stationary member 26 and the pressing roller 31 to form the nip N between the fixing belt 21 and the pressing roller 31 through which the recording medium P is conveyed. As illustrated in FIG. 3, both ends of the stationary member 26 in a width direction of the stationary member 26 parallel to an axial direction of the fixing belt 21 are mounted on and supported by the side plates 43 of the fixing device 20, respectively. The configuration of the stationary member 26 is described in more detail below.

As illustrated in FIG. 2, the metal member 22 has a substantially cylindrical shape. The metal member 22 serving as a heating member directly faces the inner circumferential surface 21*a* of the fixing belt 21 at a position other than the nip N. At the nip N, the metal member 22 holds the stationary member 26 via the heat insulator 27. As illustrated in FIG. 3, both ends of the metal member 22 in a width direction of the metal member 22 parallel to the axial direction of the fixing belt 21 are mounted on and supported by the side plates 43 of the fixing device 20, respectively. The flanges 29 are provided on both ends of the metal member 22 in the width direction of the metal member 22 to restrict movement (e.g., shifting) of the fixing belt 21 in the axial direction of the fixing belt 21.

The substantially-cylindrical metal member 22 heated by radiation heat generated by the heater 25 heats (e.g., transmits heat to) the fixing belt 21. In other words, the heater 25 heats the metal member 22 directly and heats the fixing belt 21 indirectly via the metal member 22. The metal member 22 may have a thickness not greater than approximately 0.1 mm to maintain desired heating efficiency for heating the fixing belt 21.

The metal member 22 may include a metal thermal conductor, that is, a metal having thermal conductivity, such as stainless steel, nickel, aluminum, and/or iron. Preferably, the metal member 22 may include ferrite stainless steel having a relatively smaller heat capacity per unit volume obtained by multiplying density by specific heat. In this exemplary embodiment, the metal member 22 includes, for example, SUS430 stainless steel as ferrite stainless steel and has a thickness of, for example, 0.1 mm.

The heater 25 may be a halogen heater and/or a carbon heater. As illustrated in FIG. 3, both ends of the heater 25 in a width direction of the heater 25 parallel to the axial direction of the fixing belt 21 are fixedly mounted on the side plates 43 of the fixing device 20, respectively. Radiation heat generated by the heater 25, which is controlled by a power source provided in the image forming apparatus 1 illustrated in FIG. 1, heats the metal member 22. The metal member 22 heats substantially the entire fixing belt 21. In other words, the metal member 22 heats a portion of the fixing belt 21 other than the nip N. Heat is transmitted from the heated outer circumferential surface of the fixing belt 21 to the toner image T on the recording medium P. As illustrated in FIG. 2, the temperature sensor 40, which may be a thermistor, faces the outer circumferential surface of the fixing belt 21 to detect a temperature of the outer circumferential surface of the fixing belt 21. A controller controls the heater 25 according to detection results provided by the temperature sensor 40 so as to adjust the temperature (e.g., fixing temperature) of the fixing belt 21 to a desired temperature. For example, the controller may be implemented as a central processing unit (CPU), and provided with associated volatile (RAM) and non-volatile (ROM) memory units. The controller operates by loading and executing programs stored in the ROM. The programs may be installed as stand-alone modules or downloaded over a wired or wireless network, including the Internet.

As described above, for the fixing device 20 according to this exemplary embodiment, the metal member 1 does not heat a small part of the fixing belt 21 but heats substantially the entire fixing belt 21 in a circumferential direction of the fixing belt 21. Accordingly, even when the image forming apparatus 1 illustrated in FIG. 1 forms a toner image at high speed, the fixing belt 21 is heated enough to suppress fixing failure. In other words, the relatively simple structure of the fixing device 20 heats the fixing belt 21 efficiently, resulting in a shortened warm-up time, a shortened first print time, and the downsized image forming apparatus 1.

The substantially-cylindrical metal member 22 has an outer diameter of, for example, approximately 59.5 mm and is disposed opposite the fixing belt 21 in such a manner that a certain clearance is provided between the inner circumferential surface 21*a* of the fixing belt 21 and the metal member 22 over an area along the inner surface of the fixing belt 21 except for where the nip N is formed. The clearance δ, that is, a gap between the fixing belt 21 and the metal member 22 at all points along the inner surface of the fixing belt 21 other than the nip N, is not greater than 1 mm, expressed as 0 mm<δ=<1 mm. Accordingly, the fixing belt 21 does not slidably contact the metal member 22 over an increased area, thus suppressing wear of the fixing belt 21. At the same time, the clearance provided between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21.

A lubricant, such as fluorine grease or silicone oil, is applied between the inner circumferential surface 21*a* of the fixing belt 21 and the metal member 22, so as to decrease wear of the fixing belt 21 as the fixing belt 21 slidably contacts the metal member 22. The outer circumferential surface of the metal member 22 has a rough surface portion A to enhance the holding performance of the lubricant. In this exemplary embodiment, the metal member 22 has a cross section of a substantially circular shape. Alternatively, the metal member 22 may have a cross section of a polygonal shape.

As illustrated in FIG. 2, the reinforcement member 23 reinforces the stationary member 26 which forms the nip N between the fixing belt 21 and the pressing roller 31. The reinforcement member 23 is fixedly provided inside the loop formed by the fixing belt 21 and faces the inner circumferential surface 21*a* of the fixing belt 21. As illustrated in FIG. 3, a width of the reinforcement member 23 in a width direction of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly mounted on the side plates 43 of the fixing device 20, respectively, in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip N. Specifically, as illustrated in FIG. 2, the reinforcement member 23 is a plate member that is disposed so as to divide the interior of the metal member 22 into substantially two spaces.

In order to provide the above-described capabilities, the reinforcement member 23 may include metal material having great mechanical strength, such as stainless steel and/or iron. The reinforcement member 23 is also formed so as not to be heated directly by the heater 25.

Specifically, an opposing face of the reinforcement member 23 which faces the heater 25 may include a heat insulation material partially or wholly. Alternatively, the opposing face of the reinforcement member 23 disposed opposite the heater 25 may be mirror-ground. Accordingly, heat radiated by the heater 25 toward the reinforcement member 23 to heat the reinforcement member 23 is used to heat the metal member 22, improving heating efficiency for heating the metal member 22 and the fixing belt 21.

In addition, such a configuration prevents the stationary member 26 from being heated directly by the stationary member 26, thus preventing the fixing belt 21 from being actively heated at the nip. Consequently, the recording medium P discharged from the nip N has a decreased temperature compared to when the recording medium P enters the nip N. In other words, at the exit of the nip N, the fixed toner image T on the recording medium P has a decreased temperature, and therefore the toner of the fixed toner image T has a decreased viscosity. Accordingly, an adhesive force which adheres the fixed toner image T to the fixing belt 21 is decreased and the recording medium P is separated from the fixing belt 21. Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 2, the pressing roller 31 serves as a rotary pressing member for contacting and pressing against the outer circumferential surface of the fixing belt 21 at the nip N. The pressing roller 31 has a loop diameter of approximately 30 mm. In the pressing roller 31, an elastic layer 33 is provided on a hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip N between the pressing roller 31 and the fixing belt 21. As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the side plates 43 of the fixing device 20 via the bearings 42, respectively. A heat source, such as a halogen heater, may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the nip N to decrease bending of the metal member 22. Further, the pressing roller 31 provides increased heat insulation, and therefore heat is not transmitted from the fixing belt 21 to the pressing roller 31 easily, improving heating efficiency for heating the fixing belt 21.

As illustrated in FIG. 4, the inner circumferential surface 21*a* of the fixing belt 21 slides over the stationary member 26. The stationary member 26 includes a surface layer 26*a* disposed on a base layer 26*b*. An opposing face (for example, a sliding face) of the stationary member 26 opposing the pressing roller 31 has a concave shape of a curvature smaller than the curvature of the pressing roller 31. Thus, at an area downstream from the nip, the recording medium P discharged from the nip lightly contacts the fixing belt 21, moves along the curvature of the opposing face of the stationary member 26, and separate from the fixing belt 21. Accordingly, the fixing performance of a fixed image can be enhanced without increasing the width W of the nip. The relation between the fixing performance of fixed image and the curvatures of the stationary member 26 and the pressing roller 31 is further described below.

The base layer 26*b* of the stationary member 26 includes a rigid material (e.g., a highly rigid metal or ceramic) so that the stationary member 26 is not bent substantially by pressure applied by the pressing roller 31.

The substantially pipe-shaped metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. A deformed metal member 22 does not provide a desired nip length of the nip, degrading fixing property. To address this problem, in this exemplary embodiment, the rigid stationary member 26 is provided separately from the thin metal member 22 to help form and maintain the proper nip.

The surface layer 26*a* of the stationary member 26 is a low friction material of a coarse sheet shape. The surface layer 26*a* is preliminarily impregnated with the lubricant. Thus, the lubricant is retained at the surface of the stationary member 26 contacting the fixing belt 21. Such a configuration can suppress wearing of the stationary member 26 and the fixing belt 21 due to sliding contact of the fixing belt 21 against the stationary member 26.

As illustrated in FIG. 4, the heat insulator 27 is provided between the stationary member 26 and the heater 25. Specifically, the heat insulator 27 is provided between the stationary member 26 and the metal member 22 in such a manner that the heat insulator 27 covers surfaces of the stationary member 26 other than the sliding surface portion of the stationary member 26 over which the fixing belt 21 slides. The heat insulator 27 includes sponge rubber having desired heat insulation and/or ceramic including air pockets.

In this embodiment, the metal member 22 is disposed in proximity to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request.

In conventional on-demand fixing devices, when heat is applied to the deformed pressing roller 31 at the nip in the standby mode, the pressing roller 31 may suffer from thermal degradation due to heating of the rubber included in the pressing roller 31, resulting in a shortened life of the pressing roller 31 or permanent compression strain of the pressing roller 31. Heat applied to the deformed rubber increases permanent compression strain of the rubber. The permanent compression strain of the pressing roller 31 makes a dent in a part of the pressing roller 31, and therefore the pressing roller 31 does not provide the desired nip length of the nip, generating faulting fixing or noise in accordance with rotation of the pressing roller 31.

To address those problems, according to this exemplary embodiment, the heat insulator 27 is provided between the stationary member 26 and the metal member 22 to reduce heat transmitted from the metal member 22 to the stationary member 26 in the standby mode, suppressing heating of the deformed pressing roller 31 at high temperature in the standby mode.

A lubricant is applied between the stationary member 26 and the fixing belt 21 to reduce sliding resistance between the stationary member 26 and the fixing belt 21. However, the lubricant may deteriorate under high pressure and temperature applied at the nip, resulting in unstable slippage of the fixing belt 21 over the stationary member 26. To address this problem, according to this exemplary embodiment, the heat insulator 27 is provided between the stationary member 26 and the metal member 22 to reduce heat transmitted from the metal member 22 to the lubricant at the nip, thus reducing deterioration of the lubricant due to high temperature.

For the fixing device 20 according to this exemplary embodiment, the metal member 22 is fixedly disposed so as to face the inner circumferential surface 21*a* of the fixing belt 21 at an area other than the nip. Accordingly, the stationary member 26 is not heated directly by the metal member 22 and does not heat the fixing belt 21. Further, the heat insulator 26 provided between the stationary member 26 and the metal member 22 insulates the stationary member 26 from the metal member 22. Accordingly, the metal member 22 heats the fixing belt 21 with reduced heat at the nip. Consequently, the recording medium P discharged from the nip has a decreased temperature compared to when the recording medium P enters the nip. In other words, at the exit of the nip, the fixed toner image T on the recording medium P has a decreased temperature, and therefore the toner of the fixed toner image T has a decreased viscosity. Accordingly, an adhesive force which adheres the fixed toner image T to the fixing belt 21 is decreased and the recording medium P is separated from the fixing belt 21. Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface opposite an outer circumferential surface facing the heat insulator 27, of a concave portion of the metal member 22 into which the stationary member 26 is inserted so as to hold the metal member 22.

In this exemplary embodiment, a stainless steel sheet having a thickness of approximately 0.1 mm is bent into the substantially cylindrical metal member 22. However, spring-back of the stainless steel sheet may expand a circumference of the metal member 22, and therefore the stainless steel sheet may maintain the desired pipe shape. As a result, the metal member 22 having an expanded circumference may contact the inner circumferential surface of the fixing belt 21, damaging the fixing belt 21 or generating temperature fluctuation of the fixing belt 21 due to uneven contact of the metal member 22 to the fixing belt 21. To address this problem, according to this exemplary embodiment, the stay 28 supports and holds the concave portion (e.g., a bent portion) of the metal member 22 provided with an opening so as to prevent deformation of the metal member 22 due to spring-back. For example, the stay 28 is press-fitted to the concave portion of the metal member 22 to contact the inner circumferential surface of the metal member 22 while the shape of the metal member 22 that is bent against spring-back of the stainless steel sheet is maintained.

Preferably, the metal member 22 has a thickness not greater than approximately 0.2 mm to increase heating efficiency of the metal member 22.

As described above, the substantially cylindrical-shaped metal member 22 may be formed by bending sheet metal into the desired shape. Sheet metal is used to give the metal member 22 a thin thickness to shorten warm-up time. However, such a thin metal member 22 has little rigidity, and therefore may be easily bent or deformed by pressure applied by the pressing roller 31. Accordingly, the deformed metal member 22 may not provide a desired nip length of the nip, resulting in degraded fixing property. To address this problem, according to this exemplary embodiment, the concave portion of the thin metal member 22 into which the stationary member 26 is inserted is spaced away from the nip to prevent the metal member 22 from receiving pressure from the pressing roller 31 directly.

The following describes operation of the fixing device 20 having the above-described structure.

When the image forming apparatus 1 is powered on, power is supplied to the heater 25, and the pressing roller 31 starts rotating in the rotation direction R3. Friction between the pressing roller 31 and the fixing belt 21 rotates the fixing belt 21 in the rotation direction R2. Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 so that the recording medium P enters the nip formed between the fixing belt 21 and the pressing roller 31 pressed against each other. At the nip, the fixing belt 21 heated by the heater 25 via the metal member 22 applies heat to the recording medium P. Simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip is conveyed in a direction Y11.

The following describes the structure and operation of the fixing device 20 in detail.

As illustrated in FIG. 4, in the fixing device 20, an opposing face of the stationary member 26 opposing the pressing roller 31 has a curvature smaller than a curvature of the pressing roller. Specifically, the pressing roller 31 has an outer diameter of, for example, 30 mm, and a curvature of one fifteenth. On the other hand, the opposing face of the stationary member 26 opposing the pressing roller 31 has a concave portion of a radius R of 30 mm and a curvature of one thirtieth. For such a configuration, a light contact area (light nipping area) is formed at an area downstream from the nip (indicated by a broken-line circle Z in FIG. 4) in the rotation direction of the fixing belt 21. At the light contact area, the recording medium P contacts the fixing belt 21 with a pressure lower than a pressure which the recording medium P receives at the nip. In other words, at the area downstream from the nip, the recording medium P discharged from the nip lightly contacts the fixing belt 21. Accordingly, the image fixed on the recording medium P at the nip is further supplementarily fixed on the recording medium P at the light contact area downstream from the nip. Such a configuration enhances the fixing performance of the fixed image without increasing the nip width W, the surface pressure, and/or the fixing temperature. Further, the fixing performance of the fixed image can be enhanced while preventing cockling of the recording medium discharged from the nip and an increase in the driving torque of the fixing device 20 due to an increased friction resistance at the nip.

Figure 5:
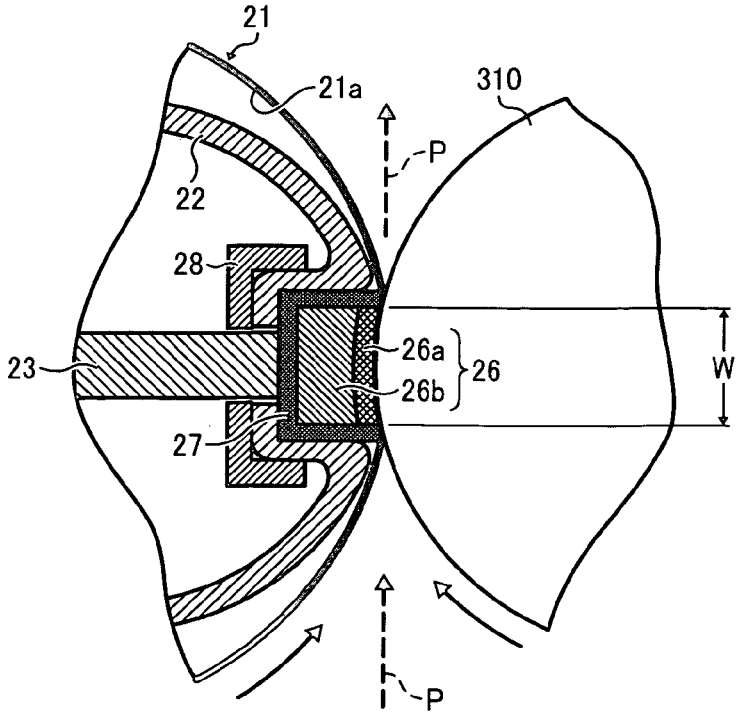
FIG. 5 is an enlarged view of a portion of a comparative example of a fixing device having no light contact area downstream from the nip.

In order to better illustrate the advantages of the present embodiment as described above, FIG. 5 shows an enlarged view of a portion of a comparative example of a fixing device. As illustrated in FIG. 5, the opposing face of the stationary member 26 opposing a pressing roller 310 has a curvature substantially equal to a curvature of the pressing roller 310, and no light contact area is formed at the area downstream from the nip. In such a configuration, the fixing performance of a fixed image is determined only by the fixing process at the nip. Therefore, in order to enhance the fixing performance, it is preferable to increase the nip width W or the surface pressure of the pressing roller 31 against the fixing belt 21 at the nip. However, in doing so, cockling may occur in a recording medium discharged from the nip, or increased friction resistance may increase the driving torque of the fixing device 20.

By contrast, for the configuration illustrated in FIG. 4 in which the light contact area is provided downstream from the nip, supplemental fixing is performed on the recording medium at the light contact area. Thus, the fixing performance of the fixed image is enhanced while preventing cockling of the recording medium discharged from the nip and an increase in the driving torque of the fixing device.

After the supplemental fixing at the light contact area, the recording medium P is separated from the fixing belt 21 at an inflexion point of the fixing belt 21 (at which the curvature of the fixing belt 21 greatly changes so that the fixing belt 21 is separated from the stationary member 26), and discharged in a direction indicated by a broken-line arrow P illustrated in FIG. 4.

In the fixing device 20, the distance between the stationary member 26 and the pressing roller 31 is greater than the thickness of the fixing belt 21 at the area downstream from the nip in the rotation direction of the fixing belt 21. Such a configuration can reliably obtain the light contact area downstream from the nip, thus enhancing the fixing performance.

Moreover, for example, an attachment-and-detachment mechanism may be provided to attach and detach the pressing roller 31 to and from the fixing belt 21 (or the stationary member 26 via the fixing belt 21). For such a configuration, in particular, it is preferable that, when the pressing roller 31 is in contact with the fixing belt 21, the distance between the stationary member 26 and the pressing roller 31 at the area downstream from the nip be greater than the thickness of the fixing belt 21.

Thus, as illustrated in FIG. 4, it is preferable to satisfy the following relation:

$$V/240 \leq X \leq V/40 \quad (1)$$

where X (mm) represents a length of the light contact area at which the recording medium P discharged from the nip lightly contacts the fixing belt 21 at the area downstream from the nip in the rotation direction of the fixing belt 21 and V (mm/second) represents a transport speed at which the recording medium P is transported to the nip.

The following describes the foregoing relation in more detail.

As illustrated in FIG. 4, while rotating at a small gap between the metal member 22 and the fixing belt 21, at the light contact area downstream from the nip, the fixing belt 21 supplies heat to the recording medium P with a surface pressure lower than a surface pressure at the nip. In other words, while passing through the light contact area, the recording medium P discharged from the nip receives heat in contact with (or in the vicinity of) the fixing belt 21 heated by the metal member 22. Thus, since the light contact area supplies heat to the recording medium P with a low surface pressure, the light contact area produces effects equivalent to the effects obtained in a case in which a heat source is disposed in the vicinity of the recording medium P. Such a configuration can enhance the fixing performance of a fixed image on the recording medium P discharged from the nip.

If the length X of the light contact area (in the transport direction of the recording medium P) is too short, the effect of enhancing the fixing performance may be reduced. By contrast, if the length X of the light contact area is too long, the amount of heat transferred from the light contact area to the recording medium P may become excessive, resulting in hot offset in the fixed image. The inventors of the present invention have found that the optimum length X of the light contact area is dependent on the transport speed (process linear velocity) V and the nip width W.

Figure 6:
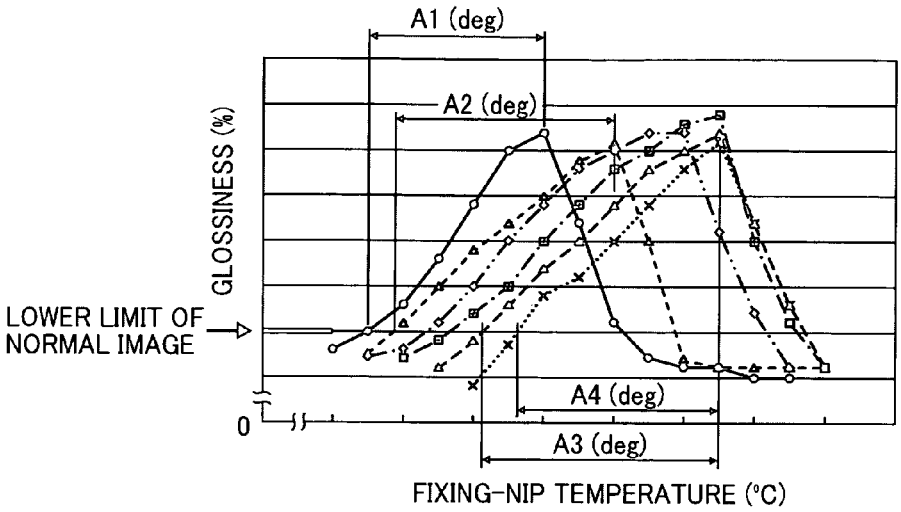
FIG. 6 is a graph showing a relation between temperature of a fixing belt at the nip and glossiness of a fixed image.

FIG. 6 is a graph showing a relation between the temperature (fixing nip temperature) of the fixing belt 21 at the nip and the glossiness of fixed image observed when the length X of the light contact area is changed in the fixing device 20 (the image forming apparatus 1) according to this exemplary embodiment.

In FIG. 6, a line graph marked by solid circles represents a case in which the length X of the light contact area is 4.0 mm, a line graph marked by open triangles represents a case in which the length X of the light contact area is 3.0 mm, a line graph marked by solid diamonds represents a case in which the length X of the light contact area is 2.0 mm, a line graph marked by open squares represents a case in which the length X of the light contact area is 1.0 mm, a line graph marked by solid triangles represents a case in which the length X of the light contact area is 0.5 mm, and a line graph marked by crosses represents a case in which the length X of the light contact area is 0.3 mm. The glossiness of FIG. 6 is an average of gloss values in an area of 9 mm×18 mm in a fixed image obtained when a solid image of a toner attached amount of 1.0 $mg/cm^2$ is formed in a recording medium P of a sheet thickness of 70 $g/m^2$. In FIG. 6, the transport speed (process linear velocity) V of the recording medium P is set to 120 mm/second.

A fixed image needs to have a glossiness greater than a certain lower limit to be acceptable as a normal fixed image. However, FIG. 6 shows that, as the length X of the light contact area increases, the lower limit of the fixing nip temperature shifts to the low temperature side (e.g., the left side of FIG. 6). Further, regardless of the length X of the light contact area, the greater the fixing nip temperature, the higher the glossiness. However, as the fixing nip temperature further rises, the glossiness does not continue to rise, and gradually decreases after exceeding a peak value. This is because hot offset is caused by an excess amount of heat applied at the nip and the light contact area, and uneven glossiness due to the hot offset becomes obvious at glossiness lower than the peak value. Therefore, the fixing nip temperature corresponding to the peak value of glossiness is an upper temperature limit at which a fixed image acceptable as a normal image can be formed.

As can be appreciated by those skilled in the art, the greater the range (hereinafter, "acceptable fixing range") between the lower and upper limits, the greater the design freedom of the fixing device. Meanwhile, in consideration of the control ripple of the fixing temperature and/or a decrease in temperature at the entry of the recording medium P into the nip, it is preferable to set a fixing temperature greater than a certain acceptable fixing range (for example, a target range A (deg)). In a case in which the length X of the light contact area is relatively long (for example, 4.0 mm, marked by solid circles), an increased amount of heat is applied to the recording medium P, which is advantageous in fixing performance. As a result, although the lower limit of the fixing nip temperature is lowered, an excessive amount of heat is applied to the recording medium P at the nip. The glossiness of a fixed image rapidly reaches a peak value and further enters a range of hot offset, and an acceptable fixing range A1 (deg) becomes lower than the target range A (deg). Thus, the target acceptable fixing range cannot be obtained.

By contrast, in a case in which the length X of the light contact area is relatively short (for example, 0.3 mm, marked by crosses), a reduced amount of heat is applied to the recording medium P, which is disadvantageous in fixing performance. As a result, although the lower limit of the fixing nip temperature rises, the peak value of the glossiness does not increase in association with the length X of the light contact area and remains substantially the same temperature as a temperature in a case in which the length X of the light contact area is 0.5 to 1.0 mm. As a result, an acceptable fixing range A4 (deg) becomes greater than the target range A (deg). Thus, the target acceptable fixing range cannot be obtained.

Further, in a case in which the length X of the light contact area is 0.5 mm, marked by solid triangles, the acceptable fixing range A3 (deg) is equivalent to the target range A (deg).

Thus, the target acceptable fixing range can be obtained. Moreover, in a case in which the length X of the light contact area is 3.0, mm marked by open triangles, the acceptable fixing range A2 (deg) is equivalent to the target range A (deg). Thus, the target acceptable fixing range can be obtained.

The inventors of the present invention have found that the optimum length X of the light contact area depends on the transport speed (process linear velocity) V mm/sec and, when V/240>X, formation of the light contact area has only limited effect and, as with the fixing device illustrated in FIG. 5, hardly enhances fixing performance.

Further, when X>V/40, the amount of heat that the recording medium P receives from the light contact area becomes excessive and the curve of glossiness rising from the lower limit of the fixing nip temperature becomes drastic, resulting in hot offset at relatively low temperatures. Thus, the relation between the length X mm of the light contact area and the transport speed V mm/sec preferably is $V/240 \leq X \leq V/40$.

Further, in this exemplary embodiment, when the nip width of the nip is W mm, the length X of the light contact area preferably satisfies the following relation:

$$X \leq W \times 0.4 \quad (2)$$

This is because, even if $V/240 \leq X \leq V/40$, the nip width of the nip formed by the stationary member 26 and the pressing roller 31 that oppose each other via the fixing belt 21 may fluctuate, resulting in fluctuation in fixing performance. Specifically, if the length X of the light contact area is greater than 40% of the nip width W which is a length of the nip in the transport direction of the recording medium P, the action of the fixing belt 21 and/or the recording medium P fluctuates at the exit of the nip. By contrast, if the light contact area is too broad as compared to the nip, the hardness of the fixing belt 21 and/or the thickness of the recording medium P may prevent the stable action of the fixing belt 21 and/or the recording medium P, resulting in fluctuation in the time during which the fixing belt 21 contacts the recording medium P at the light contact area.

Thus, the relation between the length X mm of the light contact area and the nip width W mm is preferably $X \leq W \times 0.4$.

Further, according to this exemplary embodiment, the nip width W is, for example, approximately 6.5 mm.

Further, in this exemplary embodiment, it is preferable that the length of a gap between the fixing belt 21 and the metal member 22 is not greater than the difference between the inner diameter of the fixing belt 21 and the outer diameter of the metal member 22 at the area downstream from the nip in the rotation direction of the fixing belt 21.

In this exemplary embodiment, the difference between the inner diameter of the fixing belt 21 and the outer diameter of the metal member 22 is, for example, approximately 0.5 mm. However, if the inner diameter of the fixing belt 21 is increased by inadvertent loosening of the fixing belt 21 beyond the difference between the inner diameter of the fixing belt 21 and the outer diameter of the metal member 22, heat from the metal member 22 is not efficiently transferred to the fixing belt 21, resulting in inadequate performance in the supplementary fixing process performed by the light contact area. Hence, for this exemplary embodiment, the gap between the fixing belt 21 and the metal member 22 at the area downstream from the nip is not greater than, for example, 0.5 mm. Further, the nip width and surface pressure of the nip, the materials of the fixing belt 21 and the pressing roller 31, and the process linear velocity V are optimized to set the above-described conditions.

In this exemplary embodiment, the temperature range in which the surface temperature of the fixing belt 21 is controlled to fall is preferably adjustable so as to change the glossiness of a fixing image. Specifically, when a high-glossiness mode is selected to increase the glossiness of a fixing image, the surface temperature of the fixing belt 21 is controlled using the heater so as to be within a lower range of temperature. By contrast, when a low-glossiness mode is selected to reduce the glossiness of a fixing image, the surface temperature of the fixing belt 21 is controlled using the heater so as to be within a higher range of temperature.

Figure 7:
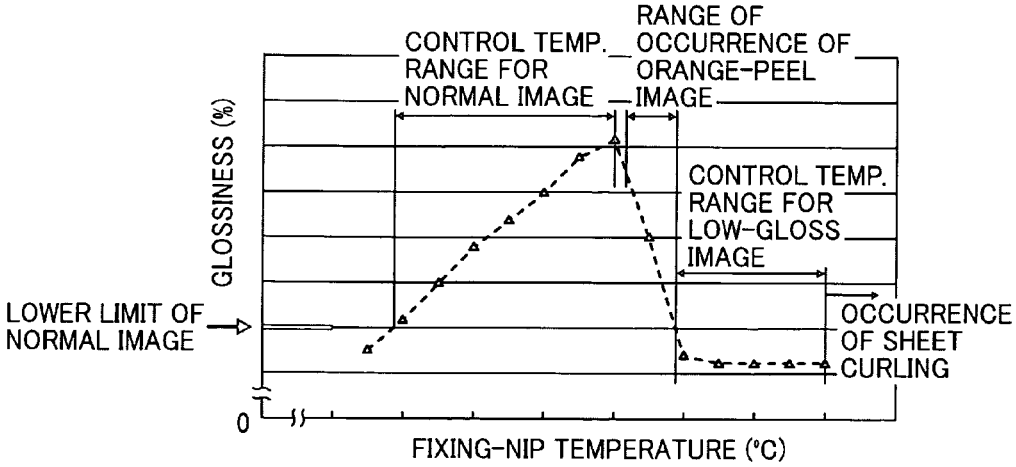
FIG. 7 is a graph illustrating variable control of the control range of fixing temperatures.
Figure 8:
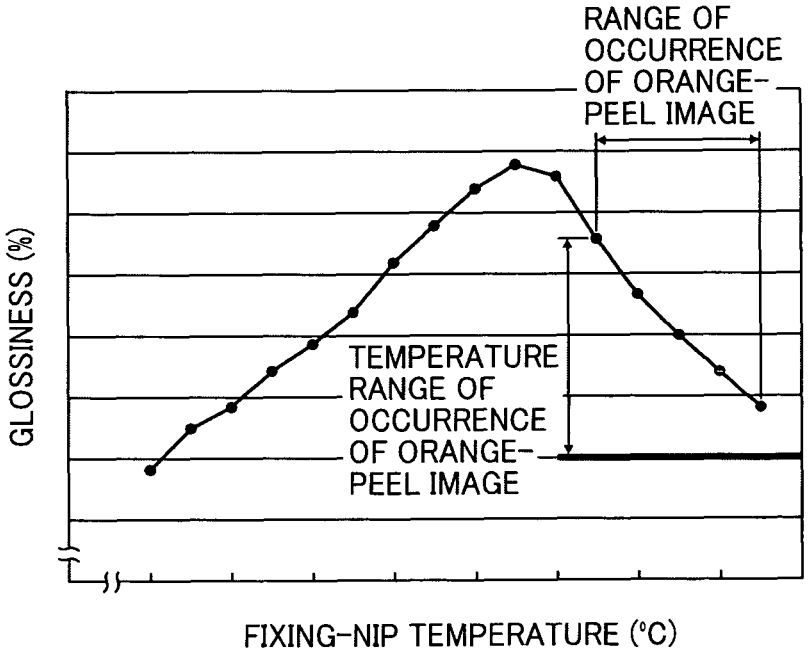
FIG. 8 is a graph showing a relation between temperature of the fixing belt at the nip and glossiness of a fixed image in the comparative example of the fixing device shown in FIG. 2.

FIG. 7 is a graph (corresponding to a graph marked by blank triangles of FIG. 6) showing a relation between fixing-nip temperature and glossiness when the length X of the light contact area is 3.0 mm in the fixing device 20 of the image forming apparatus 1 according to this exemplary embodiment. In other words, FIG. 7 is a graph illustrating variable control of the control range of fixing temperature. FIG. 8 is a graph showing a relation between fixing-nip temperature and glossiness in a comparative example of a fixing device having no light contact area.

In both FIGS. 7 and 8, the term "glossiness" represents an average value of an area of 9×18 mm in a solid image fixed on a recording medium P having a thickness of 70 g/m$^2$ with a solid image toner amount of 1.0 mg/cm$^2$ on the recording medium P and a transport speed (process linear velocity) V of the recording medium P of approximately 120 mm/sec.

As illustrated in FIG. 8, for the comparative example of fixing device, as the fixing-nip temperature rises, the glossiness of the fixed image increases. Further, in a range greater than a peak value, the glossiness slowly decreases. The peak value of glossiness depends on a combination of, for example, the condition of the nip, process linear velocity, and properties of toner. In the range in which the glossiness slowly decreases, hot offset (i.e., rough toner surface caused by an excessive amount of heat) may occur, and glossy areas and hot offset areas of low glossiness are mixed, resulting in non-uniform distribution of glossiness called "orange-peel image".

By contrast, as illustrated in FIG. 7, for the fixing device 20 according to this exemplary embodiment, the glossiness drastically decreases in a range of fixing-nip temperatures greater than the temperature corresponding to the peak value of glossiness. As a result, in a range of temperatures higher than the fixing-nip temperature corresponding to the peak value of glossiness, the temperature range in which orange-peel images occur is significantly narrowed, thus preventing formation of orange-peel images. This is an effect produced by the light contact area downstream from the nip, and in a range of temperatures higher than the range of occurrence of orange-peel image shown in FIG. 7, a control range of temperature for low glossiness can be obtained. In the control range of temperature for low glossiness, an irregular surface of an entire-surface offset image is made to form a uniform image surface of low glossiness or no glossiness. In other words, for the fixing device 20 according to this exemplary embodiment, when a high-gloss mode is selected, the control range of temperature is controlled by a heater to match a control temperature range for normal image shown in FIG. 7. By contrast, when a low-gloss mode is selected, the control range of temperature is controlled by a heater to match a control temperature range for low-gloss image shown in FIG. 7. Such a configuration allows a user to select a desired glossiness. In addition, the above-described control is performed by adjusting only the temperature of the fixing-nip without mechanically adjusting the process linear velocity, the surface pressure of the nip, or the nip width. Accordingly, the above-described control has a simple configuration and is quite advantageous in both control and cost.

As described above, in particular, the fixing device 20 according to this exemplary embodiment has a shortened warm-up time and good response. As a result, the mode switching between the control temperature range for normal image and control temperature range for low-gloss image can be smoothly performed in a short time, thus preventing occurrence of a long waiting time involved with the switching between different gloss modes. Further, using the temperature range corresponding to the temperature range in which orange-peel images occur in a comparative example of fixing device, the fixing device 20 according to this exemplary embodiment can form low-gloss images. Such a configuration can prevent curling of a recording medium P caused by an excessive fixing temperature.

As described above, for this exemplary embodiment, since the opposing face of the stationary member 26 opposing the pressing roller 31 has a curvature smaller than a curvature of the pressing roller 31, a recording medium P comes into light contact with the fixing belt 21 at an area (i.e., the above-described light contact area) downstream from the nip. Thus, even when the fixing device 20 (or the image forming apparatus 1) operates at high speed with a shortened warm-up time and/or a shortened first print time, the fixing device 20 can form an image of good fixing performance while preventing faulty fixing, cockling of a recording medium discharged from the nip, and an increased driving torque of the fixing device 20.

Figure 9:
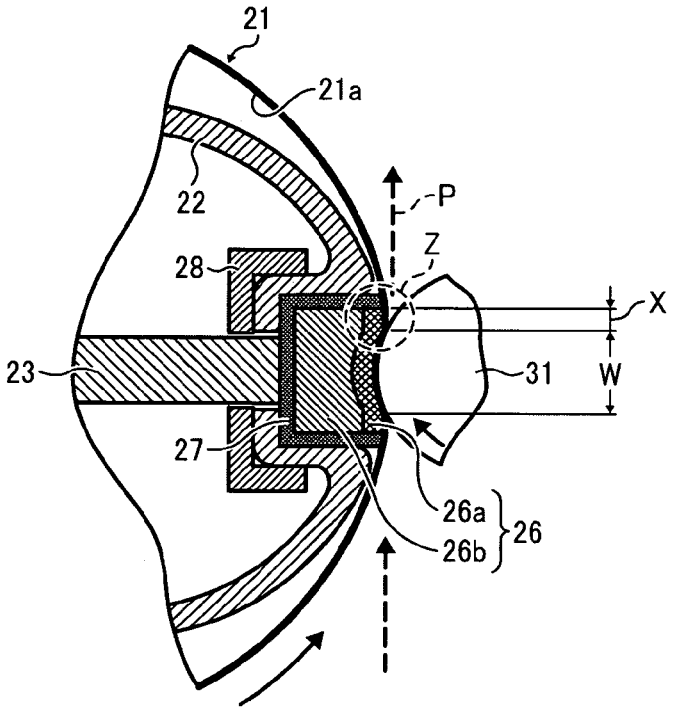
FIG. 9 is an enlarged view of a nip and its neighboring area of a fixing device according to another exemplary embodiment of the present disclosure.

According to this exemplary embodiment, the opposing face of the stationary member 26 opposing the pressing roller 31 to form the nip has a concave shape. Alternatively, a portion of the opposing face of the stationary member 26 may have a flat, planar shape. For example, as illustrated in FIG. 9, in the opposing face of the stationary member 26, a nip formation area (e.g., an area having a nip width W in FIG. 9) may be concave while the other areas except the nip formation area (e.g., an area of a width X downstream from the nip and an area upstream from the nip) may be flat. Even for such a configuration, the curvature of the opposing face of the stationary member 26 opposing the pressing roller 31 is smaller than the curvature of the pressing roller 31, thus producing effects equivalent to those of the fixing device illustrated in FIG. 4.

Figure 10:
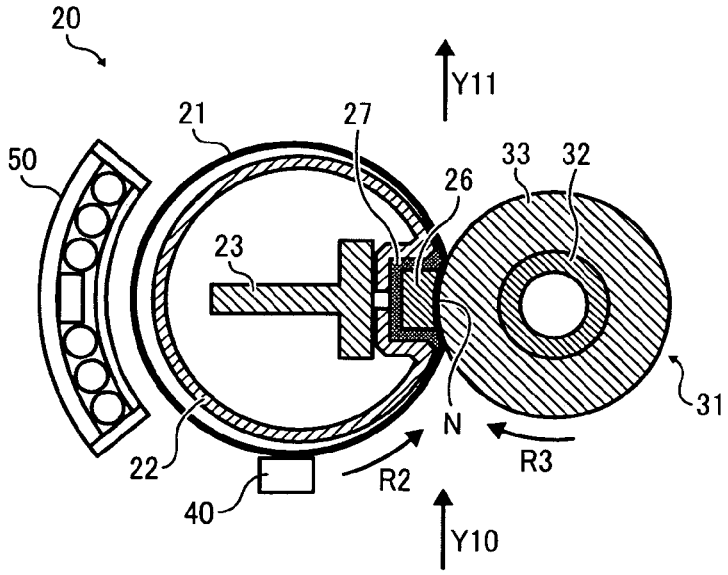
FIG. 10 is a sectional view of a fixing device according to still another exemplary embodiment of the present disclosure.

With reference to FIG. 10, the following describes a fixing device 20 according to another exemplary embodiment.

FIG. 10 is a sectional view of the fixing device 20. The fixing device 20 illustrated in FIG. 10 is different from the fixing device 20 illustrated in FIG. 2 in that the metal member 22 illustrated in FIG. 10 is heated by electromagnetic induction of an induction heater 50, located outside the metal member 22 rather than inside the metal member 22.

As with the fixing device 20 illustrated in FIG. 2, the fixing device 20 illustrated in FIG. 10 also includes a fixing belt 21 serving as a belt member, a stationary member 26, a metal member 22 of a substantially cylindrical shape, a reinforcement member 23, a heat insulator 27, a pressing roller 31 serving as a rotary pressing member, and a temperature sensor 40. Further, an opposing face of the stationary member 26 opposing the pressing roller 31 has a curvature smaller than a curvature of the pressing roller 31, and a light contact area is formed at an area downstream from a nip between the fixing belt 21 and the pressing roller 31 in a rotation direction R2 of the fixing belt 21.

The fixing device 20 includes an induction heater 50 serving as a heater instead of the heater 25 illustrated in FIG. 2. In the fixing device 20 illustrated in FIG. 2, radiation heat generated by the heater 25 heats the metal member 22. By contrast, in the fixing device 20 illustrated in FIG. 10, the induction heater 50 heats the metal member 22 by electromagnetic induction.

The induction heater 50 includes an exciting coil, a core, and a coil guide. The exciting coil includes litz wires formed of bundled thin wires, which extend in the axial direction of the fixing belt 21 (e.g., a direction perpendicular to a surface of a sheet on which FIG. 10 is printed) to cover a part of the fixing belt 21. The coil guide includes heat-resistant resin and holds the exciting coil and the core. The core is a semi-cylindrical member including a ferromagnet having a relative magnetic permeability in a range of from approximately 1,000 to approximately 3,000, such as ferrite. The core includes a center core and a side core to generate magnetic fluxes toward the metal member 22 effectively. The core is disposed opposite the exciting coil extending in the width direction of the fixing belt 21.

The following describes operation of the fixing device 20 having the above-described structure. The induction heater 50 heats the fixing belt 21 rotating in the rotation direction R2 at a position at which the fixing belt 21 faces the induction heater 50. Specifically, a high-frequency alternating current is applied to the exciting coil to generate magnetic lines of force around the metal member 22 in such a manner that the magnetic lines of force are alternately switched back and forth. Accordingly, an eddy current is generated on the surface of the metal member 22, and electric resistance of the metal member 22 generates Joule heat. The Joule heat heats the metal member 22 by electromagnetic induction, and the heated heating member 22 heats the fixing belt 21.

In order to heat the metal member 22 effectively by electromagnetic induction, the induction heater 50 may face the metal member 22 in an entire circumferential direction of the metal member 22. The metal member 22 may include nickel, stainless steel, iron, copper, cobalt, chrome, aluminum, gold, platinum, silver, tin, palladium, and/or an alloy of a plurality of those metals, or the like.

The reinforcement member 23 illustrated in FIG. 10 is also disposed so as not to be easily heated by the induction heater 50. Specifically, the reinforcement member 23 includes a metal resistant to electromagnetic induction heating.

For the fixing device 20 illustrated in FIG. 10, as with the fixing device 20 illustrated in FIG. 2, the opposing face of the stationary member 26 opposing the pressing roller 31 has a curvature smaller than a curvature of the pressing roller 31. Thus, even when the fixing device 20 (or the image forming apparatus 1) operates n at high speed with a shortened warm-up time and a shortened first print time, the fixing device 20 can form an image of good fixing performance while preventing faulty fixing, cockling of a recording medium discharged from the nip, and an increase in driving torque of the fixing belt 21.

For the fixing device 20 illustrated in FIG. 10, the induction heater 50 heats the metal member 22 by electromagnetic induction. Alternatively, a resistance heat generator may heat the metal member 22. For example, the resistance heat generator may contact an inner circumferential surface of the metal member 22 partially or wholly. The resistance heat generator may be a sheet-type heat generator such as a ceramic heater, and a power source may be connected to both ends of the resistance heat generator. When an electric current is applied to the resistance heat generator, electric resistance of the resistance heat generator increases the temperature of the resistance heat generator. Accordingly, the resistance heat generator heats the metal member 22 contacted by the resistance heat generator. Consequently, the heated metal member 22 heats the fixing belt 21. In such a configuration, the opposing face of the stationary member 26 opposing the pressing roller 31 also has a curvature smaller than a curvature of the pressing roller 31, thus providing effects equivalent to the effects provided by the fixing device 20 described above.

According to each of the above-described exemplary embodiments, a fixing belt having the multi-layer structure is used as the fixing belt 21. Alternatively, an endless fixing film including polyimide, polyamide, fluorocarbon resin, and/or metal may be used as a fixing belt to provide effects equivalent to the effects provided by the fixing device 20 described above.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. The number, positions, and shapes of the above-described components are not limited to those described in each of the above-described exemplary embodiments and may be any other number, position, and shape suitable for practicing the present disclosure.

What is claimed is:

1. A fixing device, comprising:

a substantially cylindrical metal member;

a heater to heat the metal member;

an endless, flexible fixing member disposed rotatable around the metal member, an inner circumferential surface of the fixing member heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes;

a stationary member disposed in pressure contact with the inner circumferential surface of the fixing member, the stationary member having an opposing face that opposes the rotary pressing member and has a curvature smaller than a curvature of the rotary pressing member; and a reinforcement member fixedly disposed inside the metal member in contact with the stationary member to reinforce the stationary member.

2. The fixing device according to claim 1, wherein the metal member is fixedly disposed opposite the inner circumferential surface of the fixing member over an area other than an area corresponding to the location of the nip, and wherein, at an area downstream from the nip in a rotation direction of the fixing member, a distance between the stationary member and the rotary pressing member is greater than a thickness of the fixing member.

3. The fixing device according to claim 1, wherein $V/240 \leq X \leq V/40$, where X (mm) represents a length of an area in which a recording medium discharged from the nip comes into contact with the fixing member at an area downstream from the nip in a rotation direction of the fixing member and V (mm/sec) represents a transport speed of the recording medium transported into the nip.

4. The fixing device according to claim 3, wherein $X \leq W \times 0.4$, where W (mm) represents a width of the nip in the rotation direction of the fixing member.

5. The fixing device according to claim 1, wherein, at an area downstream from the nip in a rotation direction of the fixing member, a gap between the fixing member and the metal member is equal to or smaller than a difference between an inner diameter of the fixing member and an outer diameter of the metal member.

6. The fixing device according to claim 1, further comprising a controller that changes a temperature range in which a surface temperature of the fixing member is controlled to fall to adjust glossiness of a fixed toner image.

7. The fixing device according to claim 1, wherein the smaller curvature of the opposing surface of the stationary member at an area downstream from the nip provides a lower surface pressure than the nip.

8. The fixing device according to claim 1, wherein the stationary member includes a surface layer and a base layer.

9. The fixing device according to claim 8, wherein the base layer includes a rigid material so that the stationary member is not bent by pressure applied by the pressure member.

10. The fixing device according to claim 8, wherein the surface of the surface layer is impregnated with a lubricant.

11. The fixing device according to claim 1, wherein the stationary member is separately formed from the metal member.

12. A fixing device, comprising:

a substantially cylindrical metal member;

a heater to heat the metal member;

an endless, flexible fixing member disposed rotatable around the metal member, an inner circumferential surface of the fixing member heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes; and a stationary member disposed in pressure contact with the inner circumferential surface of the fixing member, the stationary member having an opposing face that opposes the rotary pressing member and has a curvature smaller than a curvature of the rotary pressing member, wherein, when a high-gloss mode is selected to increase the glossiness of the fixed image, the controller controls the surface temperature of the fixing member to fall in a lower temperature range, and when a low-gloss mode is selected to reduce the glossiness of the fixed image, the controller controls the surface temperature of the fixing member to fall in a higher temperature range.

13. An image forming apparatus including a fixing device, the fixing device comprising:

a substantially cylindrical metal member;

a heater to heat the metal member;

an endless, flexible fixing member disposed rotatable around the metal member, an inner circumferential surface of the fixing member heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes;

a stationary member disposed in pressure contact with the inner circumferential surface of the fixing member, the stationary member having an opposing face that opposes the rotary pressing member and has a curvature smaller than a curvature of the rotary pressing member; and a reinforcement member fixedly disposed inside the metal member in contact with the stationary member to reinforce the stationary member.

14. A fixing device, comprising:

a substantially cylindrical metal member;

a heater to heat the metal member;

an endless, flexible fixing member disposed rotatable around the metal member, an inner circumferential surface of the fixing member heated by the metal member to heat and fix a toner image;

a rotary pressing member disposed opposite the metal member and pressed against an outer circumferential surface of the fixing member to form a nip between the rotary pressing member and the fixing member through which a recording medium bearing the toner image passes;

a stationary member disposed in pressure contact with the inner circumferential surface of the fixing member, the stationary member having an opposing face that opposes the rotary pressing member and has a curvature smaller than a curvature of the rotary pressing member; and a heat insulator, the heat insulator is between the stationary member and the heater.

15. The fixing device according to claim 14, wherein the heat insulator is between the stationary member and the metal member.

16. The fixing device according to claim 15, wherein the heat insulator covers surfaces of the stationary member other than a sliding surface portion of the stationary member over which the fixing member slides.

* * * * *